United States Patent [19]

Morita

[11] 4,159,837

[45] Jul. 3, 1979

[54] COMBINATION DOOR STOP AND LATCHING DEVICE

[75] Inventor: Mike Y. Morita, Los Angeles, Calif.

[73] Assignee: Morita Hardware Manufacturing, Inc., Carson, Calif.

[21] Appl. No.: 928,721

[22] Filed: Jul. 27, 1978

[51] Int. Cl.[2] ..... E05B 3/04

[52] U.S. Cl. ..... 292/127; 292/DIG. 15; 292/DIG. 19; 16/85

[58] Field of Search ..... 16/82, 84, 85, 86 R; 292/DIG. 4, DIG. 15, DIG. 19, 127

[56] References Cited

U.S. PATENT DOCUMENTS

| | | | |
|---|---|---|---|
| 308,768 | 12/1884 | Hazen | 292/DIG. 19 |
| 905,804 | 12/1908 | Fies | 292/DIG. 19 |
| 1,126,836 | 2/1915 | Newton | 16/85 |
| 1,309,310 | 7/1919 | Voight | 292/DIG. 4 |
| 1,694,023 | 12/1928 | Suck | 292/DIG. 4 |
| 1,896,363 | 2/1933 | Johnson | 292/DIG. 4 |

*Primary Examiner*—George H. Krizmanich

*Attorney, Agent, or Firm*—Francis X. Lo Jacono

[57] ABSTRACT

The combination of a door stop and releasable latching device, whereby a keeper member is mounted to a conventional door and positioned thereon to engage a stationary door stop having a latching mechanism coupled therewith, wherein the door stop comprises a main supporting body to be mounted in a fixed position relative to the keeper member, the fixed body having a slidable bumper cover which is spring biased in an outwardly direction to engage the head of the keeper, and wherein a latching lever is pivotally mounted to the fixed body and arranged to be actuated by the movement of the slidable bumper cover for releasable latching over the head of the keeper when the door is positioned in an open mode.

2 Claims, 12 Drawing Figures

COMBINATION DOOR STOP AND LATCHING DEVICE

BACKGROUND OF THE INVENTION

1. Field of the Invention

This invention relates generally to a door stop and more particularly to a door stop having an associated spring-biased, releasable-latch mechanism.

2. Description of the Prior Art

As is well known in the art, various problems and difficulties are encountered in providing suitable means to prevent doors from opening too wide and butting against the adjacent wall, and at the same time providing a device that can be employed as a latching device to hold the door in an open position.

Many and various types of door stops have been tried and used, and some of these also included self-latching devices in combination therewith. However, the known devices have features that restrict their use and placement with respect to the doors and surrounding areas. Further, most known devices are too complicated to operate and/or are too expensive to install and maintain, especially when a building would require large amounts of hardware for such a purpose.

Many doors are provided with self-closing devices that are not compatible with known door stop and latching mechanisms. Thus, there is a need at the present time for a combination door stop and self-releasable latching mechanism that will be adaptable to most types of hinged doors.

SUMMARY OF THE INVENTION

The present invention comprises a door stop that includes an automatic self-releasing latching mechanism, whereby a door can be opened to its fullest open position and be held therein by a latching-keeper member and door stop provided with a latching mechanism, the keeper being mounted to the door and the door stop being mounted to the adjacent wall or floor so as to become engaged by the keeper member.

The door stop includes a spring-biased slidable-bumper member which, when engaged by the keeper member, allows a latching lever of the latching mechanism to arcuately rise above the door stop body and to release the keeper from the latching lever.

The latching lever further includes a latching tongue arranged to be engaged by the keeper member, to allow the tongue to latch behind the head of the keeper member for the purpose of holding the associated door in an open position.

However, by simply forcing the door against the bumper, the latching lever will automatically be raised to permit the keeper to separate therefrom, allowing the door to again close.

OBJECTS AND ADVANTAGES OF THE INVENTION

The present invention has for an important object a provision wherein a door can be latched in an open position and then released from the open position back to a closed position merely by movement of the door, wherein the present device is designed to become automatically latched or unlatched by means of a keeper mounted to the door.

It is another object of the invention to provide one embodiment that will be mounted to a fixed wall, and a second embodiment that is adapted to be mounted on the floor and positioned thereon to engage a keeper mounted to the door.

It is still another object of the invention to provide a combination door stop and latching device that has relatively few operating parts.

It is a further object of the invention to provide a combination door stop and latching device that is relatively inexpensive to manufacture.

It is still a further object of the present invention to provide a device of this character that is simple yet strong in construction.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
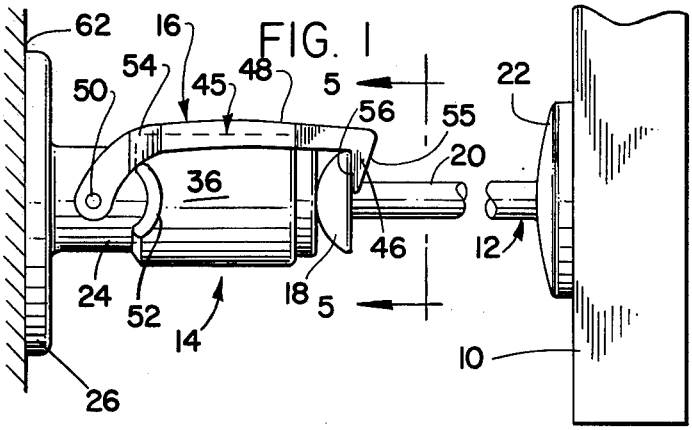
FIG. 1 is side-elevational view of the present invention showing the door stop mounted to a fixed support, and the keeper member latched to the door stop and mounted to a door.

Referring more particularly to FIG. 1, there is shown a door 10, whereon there is mounted a keeper member 12 which is positioned to engage the door-stop device, generally indicated at 14. The door stop is combined with a latching mechanism, designated at 16, shown latched to the enlarged head member 18 of keeper 12.

Thus, the keeper member 12 comprises an enlarged leading head member 18 formed on the free end of shaft 20 which includes a rear-mounting plate 22, which can be adapted to be attached to door 10 in any suitable conventional manner such as by screws or the like.

The door-stop device comprises a main body 24 having a mounting means defined by a plate 26 integrally formed at the rear end thereof, plate 26 including a plurality of holes in which screws 28 are received. A longitudinal bore 30 is disposed in body 24 having an integral wall 32 therein, whereby a housing is defined to receive a biasing means such as a coiled spring 34.

Figure 2:
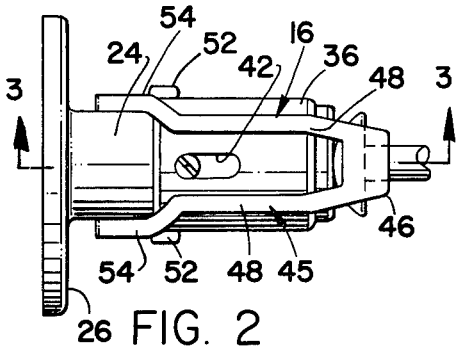
FIG. 2 is a top plan view thereof.

Slidably received over body 24 is a bumper cover 36 having a cylindrical configuration of that of body 24; thus, cover 36 is provided with an enlarged bore 38 defined by cylindrical wall 39, whereby the front end thereof is closed by an end bumper wall 40 which is adapted to engage head 18 of keeper 12 and further support spring 34. Hence, it can be seen in FIGS. 3 and 4 that biasing spring 34 is interposed between body 24 and bumper cover 36, whereby force is continuously applied to the slidable bumper cover 36 in an outwardly direction. However, it is to be noted that a limit means is provided to limit the reciprocal movement of bumper 36. The limit means is herein shown as a pair of oppositely disposed slots 42 formed in cylindrical wall 39 of cover 36. Within each slot is positioned a stop pin, indicated as screw 44, which is threadably secured to body 24. It, therefore, can be seen in FIGS. 2, 3 and 4 that the longitudinal movement of bumper cover 36 is established by the length of slots 42.

Referring now to the latching mechanism 16, said latching mechanism comprises a latching lever 45 which includes a latching tongue 46 formed at the leading end thereof having a pair of bifurcated side arms 48 wherein the free ends thereof are pivotally connected to the rearward portion of body 24 by pins 50. Thus, latching lever 45 is arranged to pivot relative to body 24 and cover 36, whereby lever 45 is rotated by the longitudinal movement of cover 36.

Figure 3:
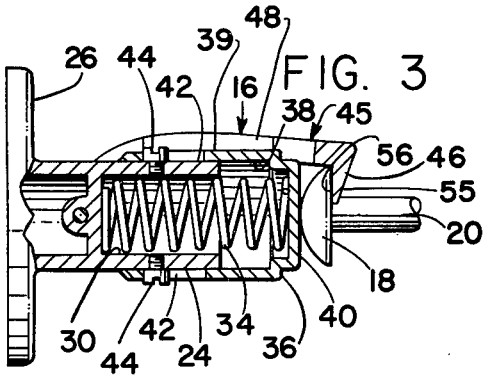
FIG. 3 is a cross-sectional view taken substantially along line 3—3 of FIG. 2.
Figure 5:
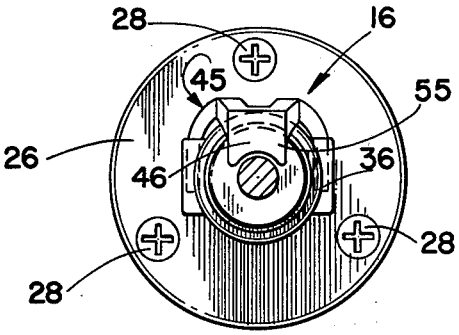
FIG. 5 is a cross-sectional view taken along line 5—5 of FIG. 1.

Accordingly, an actuating means (comprising a pair of oppositely positioned engaging ears 52) is provided to raise and lower lever 45, the ears being formed adjacent the open end of bumper cover 36 so as to abut against the depending leg member 54 of lever arms 48. Thus, as the door opens, head 18 of keeper 12 engages the front inclined surface 55 of tongue 46 so as to raise latch lever 45 over head 18. Tongue 46 then drops behind head 18, as seen in FIGS. 1 and 3, whereby head 18 is coupled between bumper wall 40 and the inner substantially flat vertical surface 56, thereby locking door 10 in place.

Figure 4:
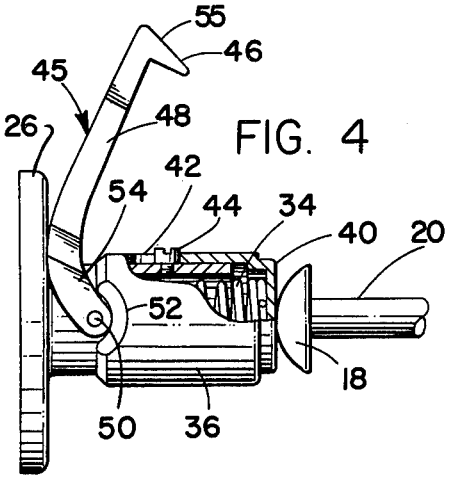
FIG. 4 is a side-elevational view shown in an engaging position with the keeper member, a portion of the door stop being in cross section.

When it becomes time to release door 10, door 10 is moved so that head 18 engages bumper wall 40, thus moving bumper cover 36 inwardly along body 24 against the force of spring 34, as seen in FIG. 4. At this time, ears 52 engage leg members 54 of arms 48, forcing lever 45 to rotate about pins 50. This then frees head 18 from latching tongue 46, allowing door 10 to close and head 18 to disengage from bumper 36 before lever 45 returns to a horizontal position, which is accomplished by spring 34 forcing bumper 36 back to a fully extended position.

Figure 6:
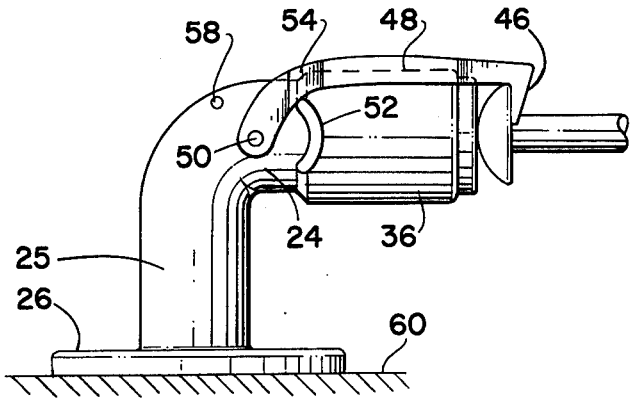
FIG. 6 is a side-elevational view showing an alternative arrangement of the main body of the door stop whereby the door stop is affixed to a floor.
Figure 7:
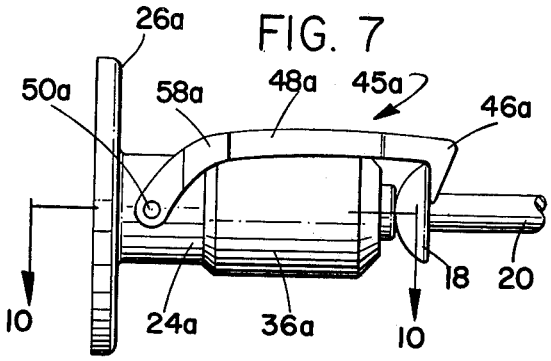
FIG. 7 is a side-elevational view of an alternative arrangement of the door stop having a different means of actuating the latching means.

FIG. 6 illustrates the above-described device wherein an alternative arrangement of body 24 has been made. That is, body 24 includes an extended neck member 25 bent at right angles to body 24 and having a mounting plate 26 arranged to be secured to floor 60, rather than to a wall member 62 as shown in FIG. 1. Further, a stop means, such as pin 58, is provided at the rear of body 24, whereby latch lever 45 engages pin 58—thereby limiting its rearward rotation.

Referring now to the invention as shown in FIGS. 7 through 12, there is shown therein an alternative actuating means. However, the general design of door-stop device **14*a* is similar to the above-described device 14; that is, body 24*a* includes a bore 30*a* and a slidably disposed bumper cover 36*a*. Interposed between body 24*a* and bumper 34*a* is a spring member 34*a* supported within bore 30*a* and 38*a* of body 24*a* and bumper 36*a***, respectively.

Bumper cover **36*a* includes slots 42*a* and pins 44*a* to limit longitudinal movement of cover 36*a*. Further, latching lever 45*a* comprises bifurcated lever arms 48*a* pivoted to body 24*a* at one end thereof; and at the opposite free end thereof there is provided latching tongue 46*a***.

Figure 10:
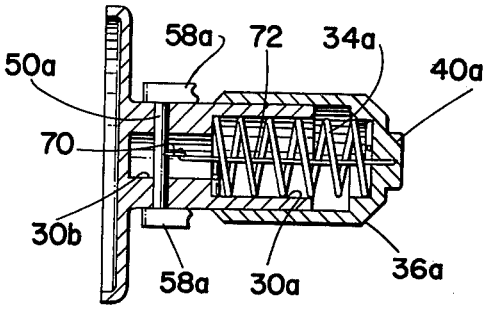
FIG. 10 is a cross-sectional view taken substantially along line 10—10 of FIG. 7.
Figure 8:
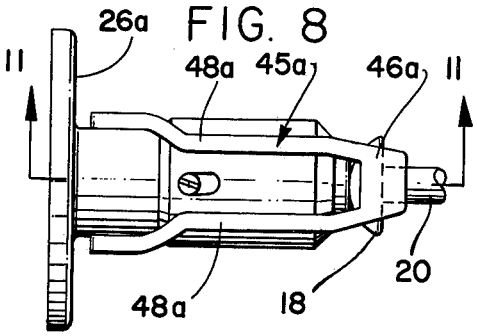
FIG. 8 is a top-plan view thereof.

However, pivot pin **50*a* as seen in FIG. 10 passes transversely through body 24*a* having legs 58*a* mounted thereto, wherein pin 50*a* defines a rotatable shaft passing through a reduced diameter bore 30*b***.

Figure 11:
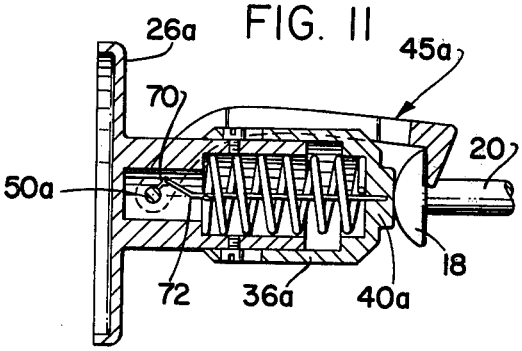
FIG. 11 is a cross-sectional view taken substantially along line 11—11 of FIG. 8 thereof.
Figure 9:
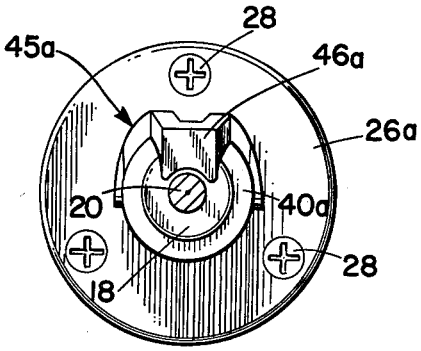
FIG. 9 is a front-elevational view thereof.
Figure 12:
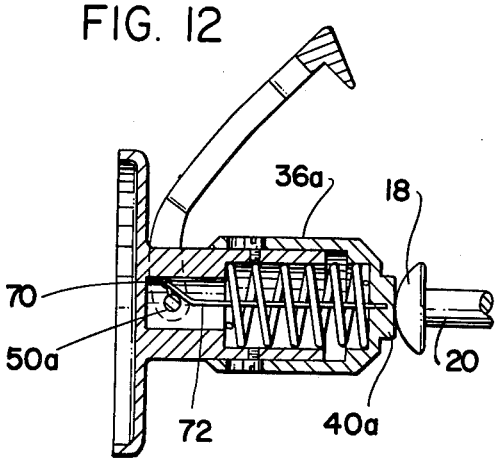
FIG. 12 is a cross-sectional view similar to FIG. 11, with the mechanism in a released position.

The actuating means is connected to shaft **50*a*, as seen in FIGS. 10, 11 and 12, and to cover 36*a*. That is, the actuating means comprises a fulcrum member 70 affixed to shaft 50*a*, and lever arm 72 journalled at one end to fulcrum member 70 and secured at the opposite end to bumper wall 40*a***.

Hence, when bumper cover **36*a* is in a fully extended position as seen in FIG. 11, fulcrum member 70 is extended upwardly and forwardly, thus positioning latching lever 45*a* in a latched mode. Hence, as head 18 engages bumper wall 40*a*, cover 36*a* moves rearwardly—carrying lever 72 rearwardly and forcing fulcrum member 70 to rotate shaft 50*a*—thereby lifting latching lever 45*a* radially upward as seen in FIG. 12. As the spring biases cover 36*a* back to a normal position, shaft 50*a* is again rotated by fulcrum 60 and lever 72 is back to the position shown in FIG. 11**.

The operation of keeper 12 is the same as recited above; and the latching and releasing thereof is similar to that described for the first embodiment.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. In combination, a door stop and latching device to releasably latch a door in an open position, wherein the device comprises:

a main body adapted to be substantially fixed in relationship to said door;

means for securing said body in a fixed position;

a bumper member slidably mounted to said main body;

a biasing means interposed between said body and said bumper member to force said bumper in an outwardly direction;

means for releasably latching said door in an open position;

means to actuate said releasable-latching means to allow said door to be closed; and keeper means affixed to said door for engagement with said latching means and said bumper member, wherein said keeper means comprises a mounting plate member; a shaft member extended outwardly from said mounting plate; and an enlarged head member formed on one end of said shaft member; and wherein said releasable latching means comprises a latching lever having a latching tongue located at one end thereof, the opposite end thereof being rotatably connected to said main body, said tongue arranged to engage said keeper means;

and wherein said actuating means comprises a rotatable shaft mounted in said main body, said shaft having said latching lever attached thereto for arcuate movement therewith; a fulcrum member secured to said shaft; and a fulcrum-lever arm connected to said fulcrum member at one end of said fulcrum lever, the opposite end thereof being secured to said bumper member to move longitudinally with said bumper member whereby said shaft and said latching lever are actuated thereby.

2. The combination as recited in claim 1, wherein said device includes means for limiting the longitudinal sliding movement of said bumper member.

* * * * *